US007438336B1

(12) United States Patent
Wolf et al.

(10) Patent No.: US 7,438,336 B1
(45) Date of Patent: Oct. 21, 2008

(54) STORM SHUTTER STUD FASTENER WITH QUICK RELEASE ARM

(76) Inventors: Edward A. Wolf, 7963 NW. 70th Ave., Parkland, FL (US) 33067; Mark Clark, 19076 Eagles Way Ct., Loxahatchee, FL (US) 33470

( * ) Notice: Subject to any disclaimer, the term of this patent is extended or adjusted under 35 U.S.C. 154(b) by 0 days.

(21) Appl. No.: 11/614,311

(22) Filed: Dec. 21, 2006

Related U.S. Application Data

(63) Continuation-in-part of application No. 10/908,999, filed on Jun. 3, 2005.

(51) Int. Cl.
*E05B 15/02* (2006.01)

(52) U.S. Cl. ..... 292/341.17; 292/304; 49/141

(58) Field of Classification Search ..... 292/300, 292/303, 341.15, 341.17, 19; 24/664; 411/522; 403/155; 49/141
See application file for complete search history.

(56) References Cited

U.S. PATENT DOCUMENTS 2,449,750 A * 9/1948 Redmond ..... 292/303
3,966,242 A * 6/1976 Vitalis ..... 292/19
5,410,841 A * 5/1995 Harris et al. ..... 49/67
6,336,678 B1 * 1/2002 Park ..... 296/216.02
6,607,224 B2 * 8/2003 Hodges ..... 292/303

* cited by examiner

*Primary Examiner*—Gary Estremsky
(74) *Attorney, Agent, or Firm*—Malin Haley DiMaggio Bowen & Lhota, P.A.

(57) ABSTRACT

A storm shutter stud fastening mechanism that includes a quick release for fast and easy removal of conventional storm shutters from a window or door from the inside of a structure in the event of an emergency by allowing occupants of the building to manually disengage a fastening stud from an anchor. The stud mechanism includes an anchor body that receives an actuating arm having prongs at one end that engage and fasten the stud to the anchor body. However, when the arm is when rotated or pivoted from one side to the other, the engaging prongs are spread by stops inside the anchor body, thereby expanding the prong distance, releasing a stud secured between them.

6 Claims, 5 Drawing Sheets

STORM SHUTTER STUD FASTENER WITH QUICK RELEASE ARM

This application is a continuation-in-part of U.S. patent application Ser. No. 10/908,999 entitled "Escape Mechanism for Hurricane Shutters" now pending and filed Jun. 3, 2005.

BACKGROUND OF THE INVENTION

1. Field of the Invention

A storm shutter panel fastener for firmly securing storm shutters to a building to cover windows and doors that includes a quick release mechanism that is manually actuated to allow inhabitants of a building enclosed with storm shutters fast and easy egress from the building.

2. Description of Related Art

Storm shutters are conventionally used to protect a building from wind damage caused by flying projectiles and rain experienced during storms such as hurricanes or cyclones. Typically, a storm shutter is a rigid panel often made of metal or aluminum in a corrugated shape that is traditionally fastened to a building with bolts and nuts, often including a holding track on one end of the shutter. In many conventional applications, wing nuts are used to secure each shutter in several locations on bolts protruding from the building.

An important drawback of such a conventional shutter fastening system is that it is virtually impossible for someone inside of the building that has storm shutters attached to the building to get out of the building in case of an emergency. The applicants have described in a prior pending patent application an escape mechanism useful with storm shutters in Ser. No. 10/908,999 filed on Jun. 3, 2005 entitled "Escape Mechanism for Hurricane Shutters." That patent application is hereby incorporated by reference as to the subject matter disclosed. The release mechanism described in this application allows for manual pivotal action on the actuating arm that can quickly and easily disengage the storm shutter fastening stud from its anchor for quick release action of the storm shutter. The actuating arm is located on the inside of the shutter for manual access by someone inside the building.

SUMMARY OF THE INVENTION

A storm shutter stud fastener for securing a storm shutter panel to a building using a plurality of individual studs each having its own stud quick release.

Using a window storm panel as an example a conventionally sized corrugated aluminum storm panel would have a plurality of stud fasteners disposed laterally for securing the storm shutter to the building. The stud fastener and quick release described herein provides for manually releasing each stud individually. The actuating arm that both secures the stud and also releases the stud quickly is used as one arm per stud and is mounted in a stud anchor that is attachable to the building. In an emergency to quickly unfasten a storm shutter panel covering a window, the inside occupant would individually quickly actuate all of the stud releasing actuating arms that secure the panel to the building from the inside (through the window opening). This action would disengage the entire storm shutter panel from the building allowing easy egress from the building.

Thus, the structure and actuation of each individual anchor stud fastener and actuating release arm will be described.

The fastening stud for securing the shutter panel through an aperture to a building is an elongated rod having an annular groove at one end that is secured by a pair of prongs on the actuating arm connected to a building anchor on the inside of the shutter panel. Each stud has a plurality of threads or grooves at the opposite end of the stud that are used with an exterior shutter panel fastener to secure the shutter from the exterior side. If the stud is released from the inside of the storm panel using the actuating arm, the exterior fastener and the stud will be disengaged allowing the shutter to be quickly removed from the building. The quick release system disclosure deals more with the stud release from the inside of the shutter and does not specifically deal with the exterior fastener which could be anything from a quick release fastener described in applicants' co-pending application or conventional fasteners for securing the shutter on the exterior side.

Thus, at each fastening point along the shutter, the stud will pass through a hole in the shutter panel and be secured on the inside to the building with the stud fastener and on the outside of the building by an additional fastener.

The system described herein includes a stud anchor within which one end of the stud is secured to the anchor body which itself is fixed either directly to a building wall or to a track that itself is mounted to a building wall.

The stud anchor has several important passages and is generally a somewhat cylindrical rigid body having a central aperture disposed therethrough which can be used to pass a bolt for securing the anchor to a wall and also to receive the fastening end of the stud. The anchor body also includes vertical slots that pass downwardly through the anchor body on each side that include in its interior first and second stops which are described below.

The actuating arm is an elongated flat piece of metal that is thin and includes a pair of prongs that are elastic and resilient and that can be spread apart and also which will return to their original position.

The actuating arm prongs secure the stud to the anchor. The prongs axe separated by a longitudinal slot so as to engage an annular groove in one end of the shutter fastening stud so that when the actuating arm is mounted inside the anchor, the stud is secured by the prongs of the actuating arm. Inside the anchor housing are also two stops which are at the top and bottom of the slots that allow the anchor arm to be inserted into the anchor body. The width of the anchor slots is approximately the same size as the distance between the prongs of the actuating arm. By rotating the actuating arm in either direction relative to the stud, the top and bottom anchor body stops cause the two resilient prongs of the actuating arm to begin to spread apart, separating the two prongs from the stud groove which allows the stud then to be free from the actuating arm so long as the prongs are spread apart.

When the actuating arm is positioned so that a portion of the prongs are mounted inside the slotted areas of the anchor and the actuating arm prongs engage a stud within the anchor housing, the system is locked and the stud cannot be removed from the anchor which is secured to the building through a plate or track or its own bolt. A shutter panel can be then attached through a hole in the shutter panel to the stud and from the exterior side of the shutter panel a fastener can be mounted securing the shutter panel to the building.

In the event of an emergency, an occupant on the inside of the building can open a window and have immediate access to a series of actuating handles that are protruding vertically above each stud anchor. A slight rotation or movement in either direction on the actuating arm quickly releases the stud mounted within the anchor housing by virtue of the stops within the anchor housing forcing the prongs to spread apart due to the rotation of the actuating arm releasing the engagement of the stud to the prongs inside the anchor housing.

The device includes a detent tab which is a small thin plate with a pair of actuating arm locking tabs protruding from the top. The main purpose is to lock the actuating arm in the open/stud release position after the arm has been rotated to the left or to the right. This allows the user to simply move or rotate the actuating arm left or right until the detent tabs projecting from the detent tab plate engage and lock the actuating arm prongs open which allows the anchor to receive a stud during installation. Once a stud has been inserted, the detent tab rear wall is depressed rearwardly which moves the locking detent tab out of the way of the actuating arm prong, allowing the actuating arm to go back to its vertical rest position locking the stud in place. In an emergency situation, the user simply rotates the actuating arm left or right overcoming the projecting retention tab forcing the actuating arm to an open position, unlocking the stud and remaining in the open position. The stud is then freely able to be removed or released from the anchor with the actuating arm locked in the open position. Although the retention tab is not an absolute requirement for the operation of the device, installation and release of the studs is enhanced. The detent tab will not in any way interfere with the action of the prongs being spread when the actuating arm is rotated.

Also, due to the fact in some applications, the anchor will have to be directly mounted by a bolt to a wall and not using a track, an enlarged central aperture is disposed in the anchor body to allow a bolt to pass through. To accommodate this, a sleeve insert is also used that can be fitted into the interior passage of the anchor body once the anchor has been mounted to the building.

As an additional safety feature, the anchor body can have a passageway on either side that receives cord or rope which can be mounted at one end and then connected to a hole in the storm shutter panel so that the panel does not drop or fall when the stud is released farther than the distance of the cord that securing the shutter to the anchor.

Thus, in the overall system for mounting each stud shutter panel, a plurality of studs would be used each having its own actuating arm and quick release mechanism.

It is an object of the system described herein to provide a secure fastener for studs that can secure shutters to a building.

It is another object of the system described herein to provide in addition to a secure stud fastener for storm shutters a very easily actuated quick release stud fastener so that the shutter could be removed from the interior of the building quickly and efficiently to allow escape.

In accordance with these and other objects which will become apparent hereinafter, the instant invention will now be described with particular reference to the accompanying drawings.

PREFERRED EMBODIMENT OF THE INVENTION

Figure 1:
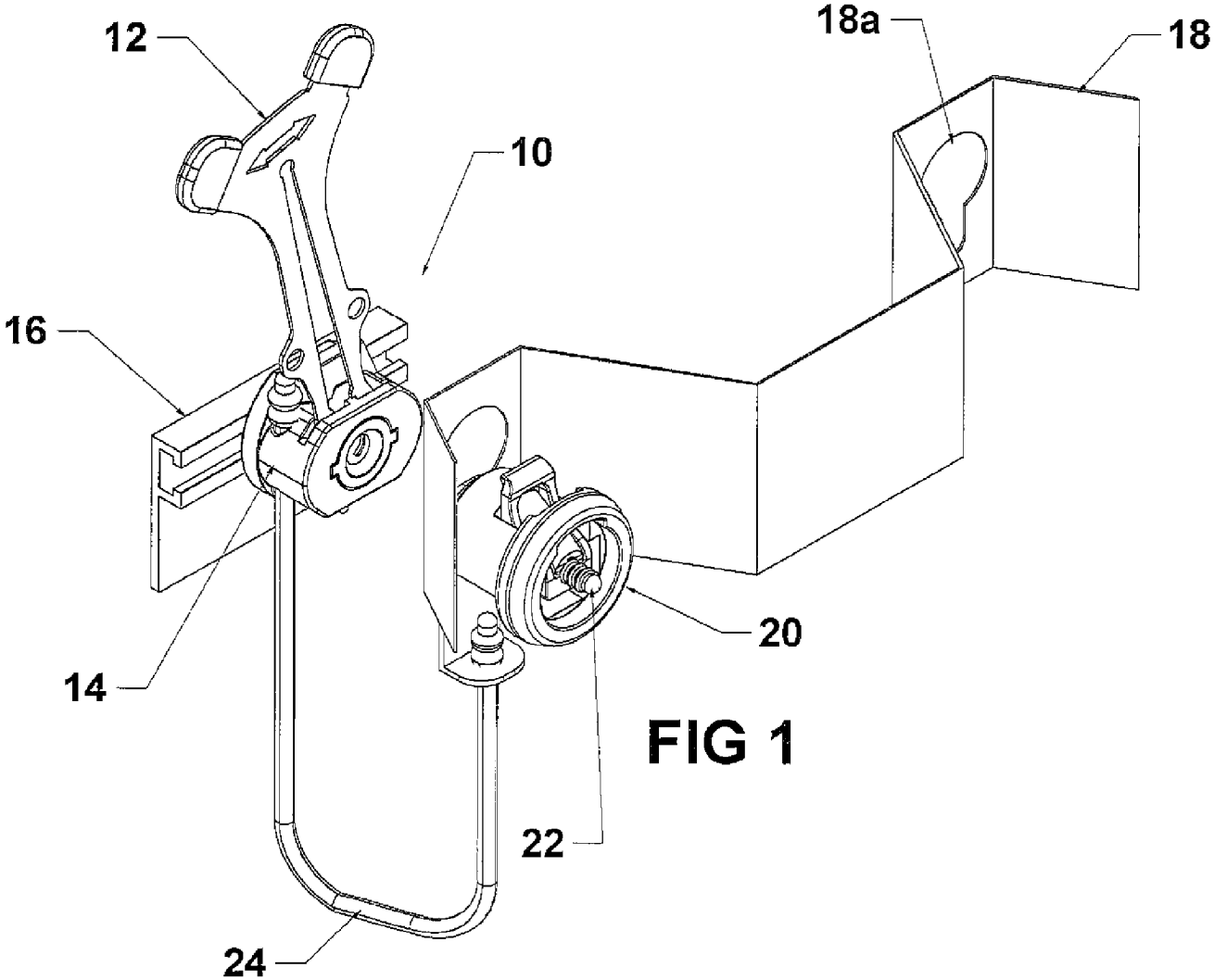
FIG. 1 shows a perspective view of the quick release and stud fastener system described herein that is an exploded view that includes a portion of a shutter, an exterior shutter stud fastener and the interior stud fastener.

Referring now to the drawings, the system described herein for the quick release is shown in FIG. 1 including a small corrugated panel 18 representing a shutter that includes an aperture 18*a* through which a stud is positioned such as stud 22 for securing the panel to a building (not shown).

A rigid plate 16 includes a F-shaped channel to which is attached a stud anchor 14. An actuating arm 12 is shown vertically disposed with a portion being inside of the stud anchor 14. Thus, the stud anchor described herein that is mounted inside of the shutter 18 is shown as 10 which includes the stud anchor 14, the mounting track 16 and an actuating stud release fastener and arm 12.

Also shown in FIG. 1 is a rope or cord 24 that can be attached through a passageway in anchor 14 at one end and to the shutter 18 at the other end through an aperture in, or attached to the shutter. Also shown in FIG. 1 is an exterior fastener 20 that is a quick release fastener for attaching and releasing the shutter 18 to stud 22 from the outside of the shutter 18.

Figure 2:
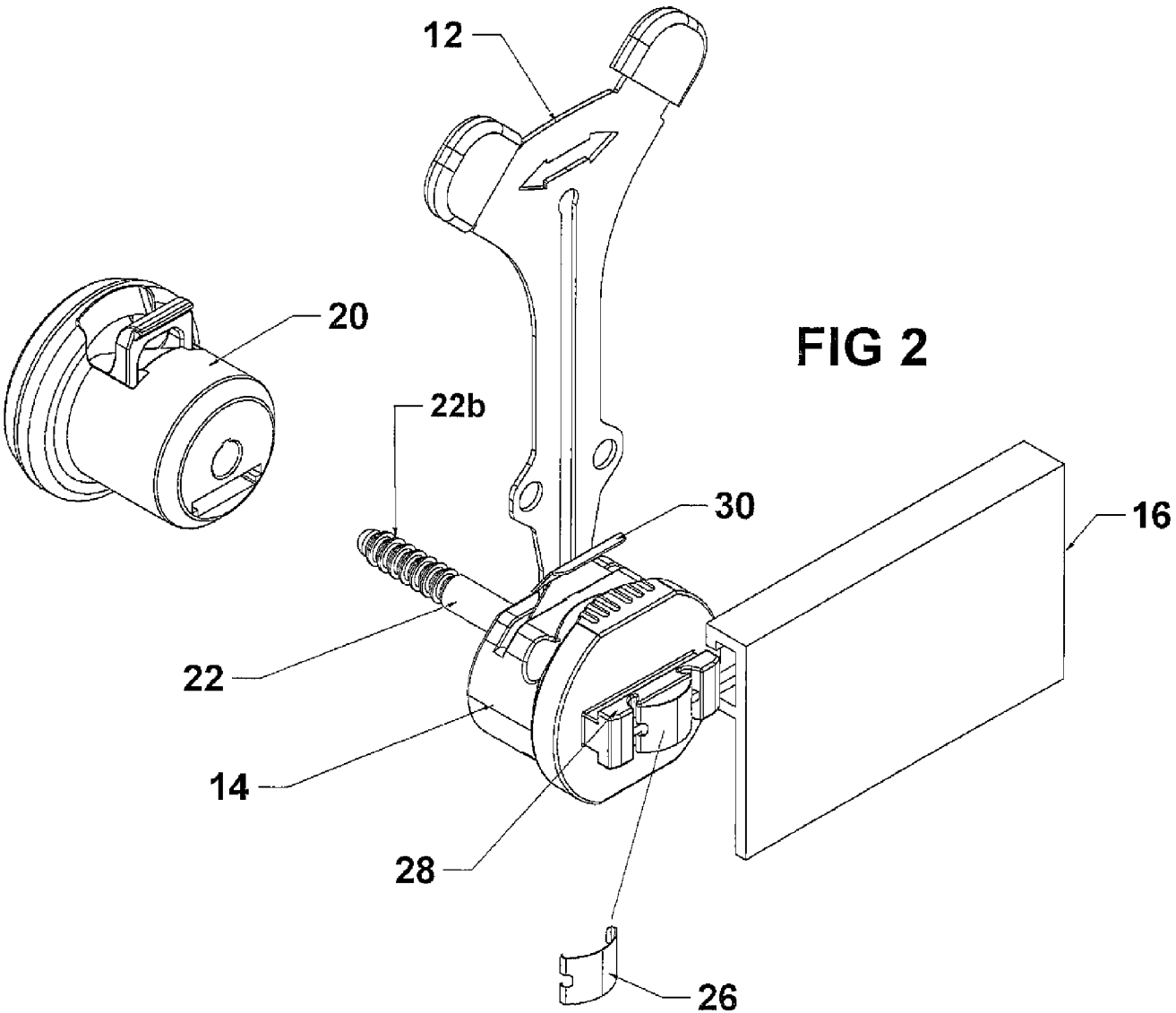
FIG. 2 shows an exploded rear perspective view of a quick release stud fastener mechanism described herein.

FIG. 2 shows a rear view of anchor 14 without a shutter. The back end portion of anchor body 14 has attached thereto an anchor retainer 28 that fits into the F-channel of plate 16 and also with a metal spring clip 26 to ensure that the anchor 14 is firmly attached in place and secured without movement to plate 16 in the F-channel. In lieu of the attachment 28 and spring clip 26, the anchor 14 could have an aperture that allows a bolt attached therethrough to the wall of the building. Plate 16 would be attached to a building wall by suitable bolt anchors.

FIG. 2 shows a detent tab 30 adjacent actuating arm 12 that is secured in a vertical slot in anchor 14 that is used to secure the actuating arm 12 in the release position once activated by moving the activation arm to the side. The detent edges are angled allowing the detent to glide along the edges as the activation arm moves to the left or right, forcing the detent away from the activation arm until the detent edge stops, allowing the detent to spring forward locking the activation arm into place and releasing the stud.

FIG. 2 also shows stud 22 mounted inside of the stud anchor 14 and having a plurality of threaded members or grooves 22*b* which fit into quick release fastener 20. However, in actual use, a shutter panel would be disposed between quick release 20 and the quick release actuating arm 12. The actuating arm 12 is accessible from the inside of the shutter so that an occupant inside a building can move the actuating arm either to the left or to the right with a slight rotation which will cause the stud 22 to be released from stud anchor 14 releasing the shutter panel at that position.

Figures 3A, 3B, 3C, 4:
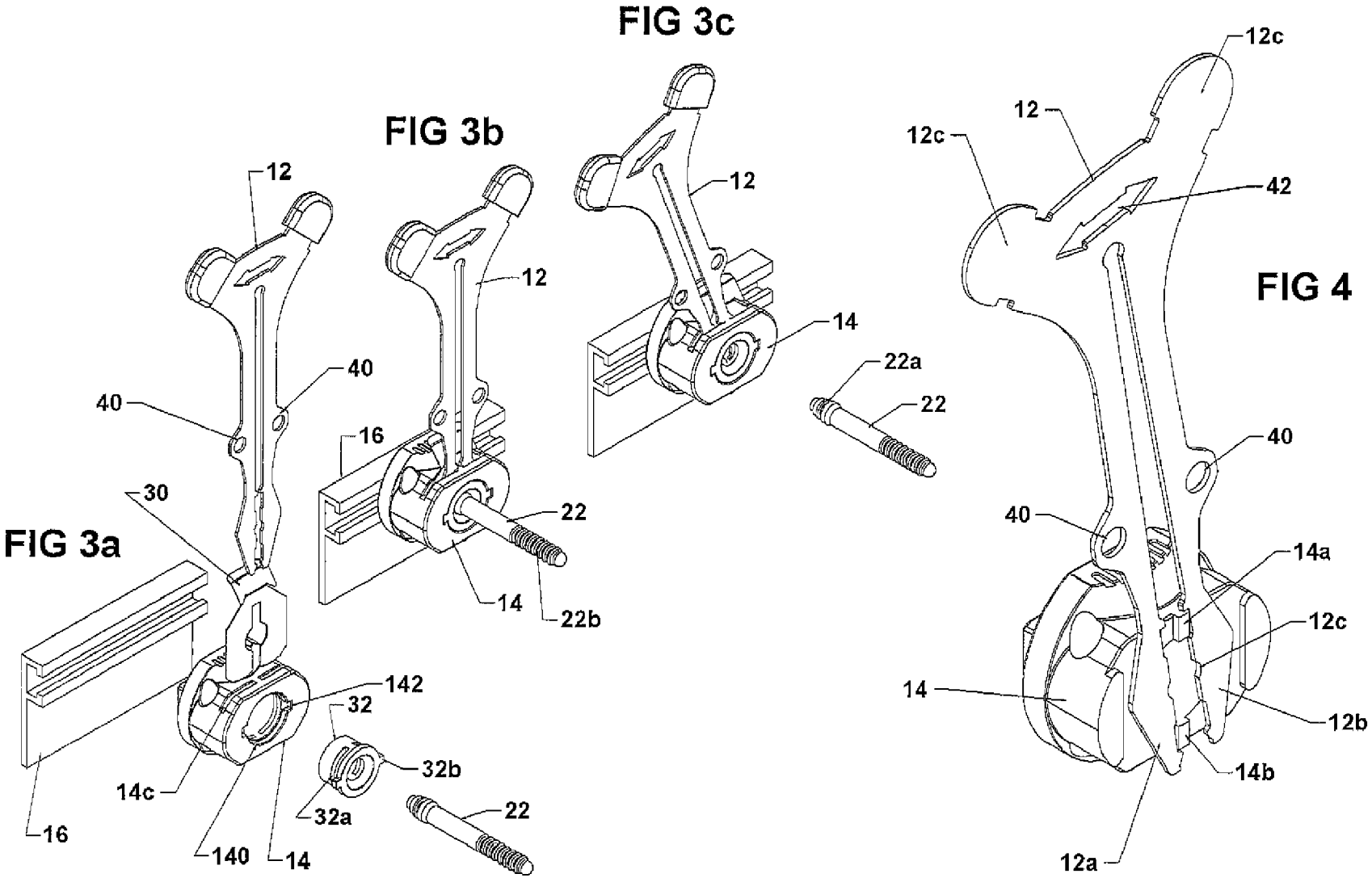
FIG. 3*a* shows an exploded front perspective view of the shutter panel stud fastener and quick release mechanism.
FIG. 3*b* shows the quick release stud fastener with a stud locked in place.
FIG. 3*c* shows the stud fastener mechanism with the actuating arm moved in one direction and the stud released in an exploded view.
FIG. 4 shows a perspective view partially cut away of the actuating arm and anchor body inside showing the operation of the actuating arm in a spread position.

FIGS. 3*a*, 3*b*, 3*c* and FIG. 4 show the construction in operation of the stud fastener with respect to anchor 14, stud 22 and the actuating arm 12. FIG. 3*a* shows an exploded view of each of the components. The stud anchor 14 which attaches to plate 16 that includes a F-track has a series of passage including a central cylindrical passage 140. A pair of vertical passages 14*c* which are slots also receive the actuating arm 12 and the detent tab plate 30 described below. The large cylindrical passageway 140 through the center of anchor 14 can be used to receive a bolt that would attach anchor 14 directly to a building and alleviating the need for plate 16. However, a sleeve 32 is used to make the passage 140 smaller that fits into the passageway 140 and is keyed in placed by tabs 32*b* which fit in a small slot 142 at the front of anchor 14. Note that the sleeve 32 also has a passageway for receiving stud 22 in a central axis and slot 32*a* that receives the actuating arm vertically.

FIG. 3*b* shows the stud fastener in a locked position with stud 22 securely fastened to anchor 14 by actuating arm 12. The entire unit is attached to plate 16 and in this position is shutter panel having an aperture therethrough can be mounted and connected to stud 22 and then from the exterior of the shutter panel a fastener such as a quick release or wing nut can be put on the threaded end of stud 22. However, if the actuating arm 12 is rotated in either direction, the stud 22 will be released from anchor 14, as shown in FIG. 3*c*.

Looking at FIG. 4, the actuation of the stud fastener and release shown with the position of the actuating arm which has a pair of prongs 12*a* and 12*b* separated by an elongated slot. The actuating arm 12 is made of an elastic, resilient material that can be deformed and which will return to its original shape. Therefore, there is sufficient resiliency in the actuating arm 12 and its prongs 12*a* and 12*b* to allow the prongs to be spread apart using anchor body stops 14*a* and 14*b* inside of the vertical slots and the anchor body that cause a separation of the prongs 12*a* and 12*b* thus separating a curved portion 12*c* that engages the annular groove 22*a* that fastens stud 22 to the actuating arm 12 which is engaged at 12*c* in the locked position shown in FIG. 3*b*. However, as shown in FIG. 4, by rotating the actuating arm in one direction, the top stop pushes against prong 12*b* and the bottom stop 14*b* pushes against prong 12*a* forcing the prongs to spread apart separating the prongs and the fastening action of the actuating arm on stud 22.

Figure 5:
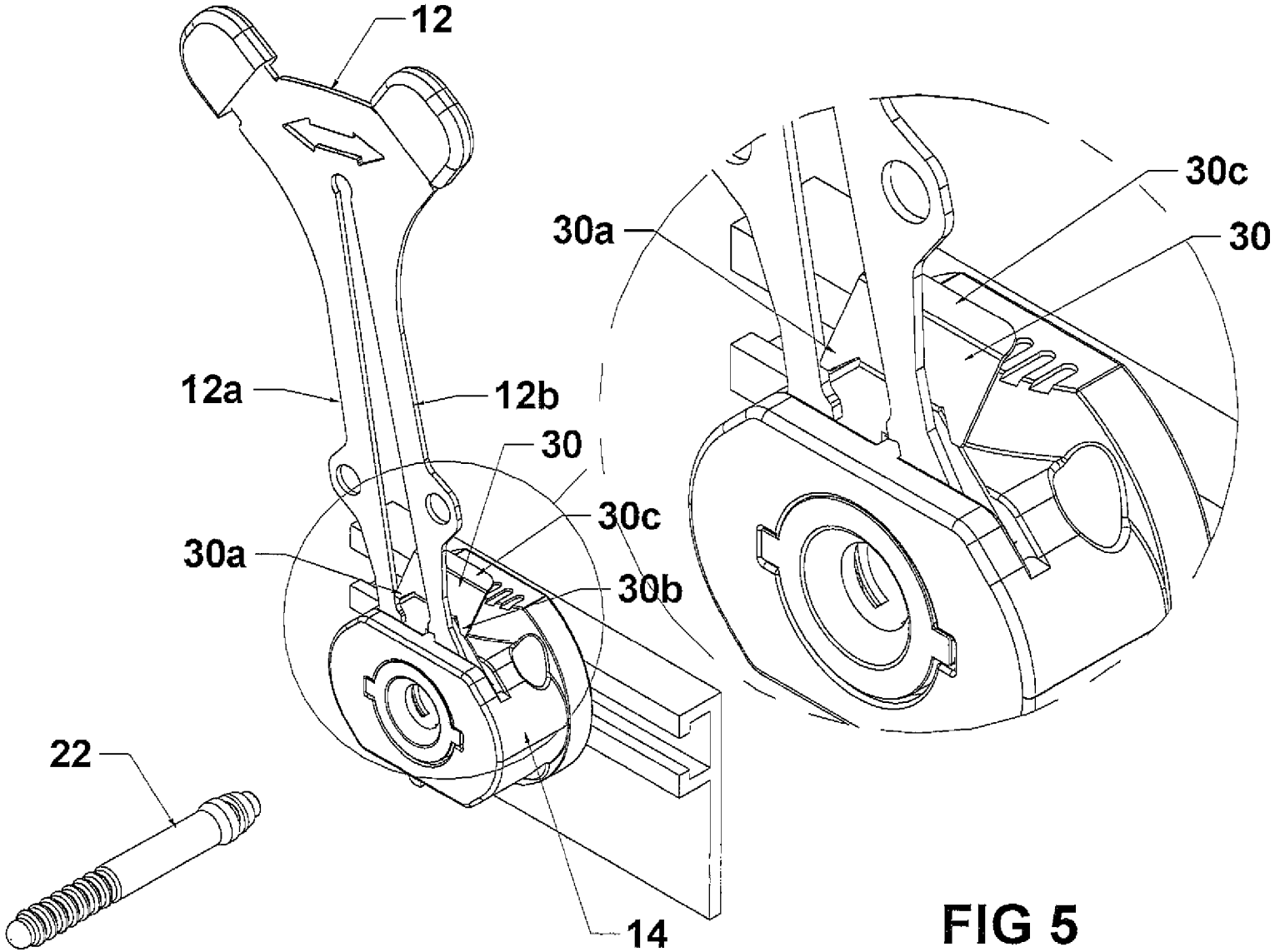
FIG. 5 shows an exploded view of the device in which the actuating arm is locked to an open position allowing for removal or insertion of the stud with an insert enlargement in a perspective view.

The device includes a detent tab 30 (FIG. 3*a*) which is a small thin plate with a pair of actuating arm locking tabs 30*a* and 30*b* protruding from the top 30*c* (FIG. 5). The main purpose of the detent tab is to lock the actuating arm 12 in the open/stud release position after the arm 12 has been rotated to the left or to the right. This allows the user to simply move or rotate the actuating arm 12 left or right until the detent tabs (30*a* or 30*b*) projecting from the detent tab 30 engage and lock the actuating arm 12 prongs (12*a* and 12*b*) open which allows the anchor 14 to receive a stud 22 during installation. Once a stud has been inserted, the detent tab rear wall 30*c* is depressed rearwardly which moves the locking detent tab out of the way of the actuating arm prong 30*a*, allowing the actuating arm 12 to be moved to its vertical rest position, locking the stud 22 in place. In an emergency situation to remove a storm shutter, the user simply rotates the actuating arm 12 left or right overcoming the projecting detent tab (30*a* or 30*b*) forcing the actuating arm 12 to an open position, unlocking the stud 22, The detent tab 30 is then locked in the open position. The stud 22 is then freely able to be removed or manually released from the anchor 14 with the actuating arm 12 locked in the open position. Although the detent tab 30 is not an absolute requirement for the operation of the device, installation and release of the studs is enhanced. The detent tab 30 will not in any way interfere with the action of the prongs 12*a* and 12*b* being spread when the actuating arm 12 is rotated.

In the overall securing of a storm shutter to a building and looking back at FIG. 1, the storm shutter 18 can have a plurality of laterally spaced aperture 18*a* either at the top or the bottom, preferably at the bottom, with the top of the shutter fitting into a channel and the bottom of the shutter being secured at various lateral points by individual studs securing the entire shutter panel to a window or door area of a building.

As shown in FIG. 1, a rope or cord 24 can be attached to both the shutter 18 and to the anchor 14 which itself does not separate from the building so when the stud is released releasing the shutter if the shutter is for a second story window, the shutter will not fall away to the ground.

Using the system described herein, shutters can be very securely fastened to a building but easily and quickly released by the stud release from the inside of a building by an occupant that wishes to escape from the building.

On a Bahama type shutter where only two bolts are used one on each side, the actuating arm can be positioned so as to be released from the inside of the shutter as described herein but could also be accessed at each end of the Bahama shutter due to the way that it is mounted by one bolt on each side. This is possible due to the fact there are only two anchor points one on each side of the Bahama shutter. If a rescue person on the outside of the building wished to get quick egress into the building, the quick release mechanism can work even though it is typically used from the inside of the building because the rescue person on the outside of the building would reach in from each side of the Bahama shutter to access and move the actuating arms and release the studs on each side freely the shutter to be opened from the hinge points for quick access into the house.

Referring now to FIG. 4, the actuating handle 12 also includes along each prong aperture 40 which is sized to receive a rope or line for attachment to the actuating arm which could be subsequently attached to allow remote actuation from each side of the actuating arm by pulling on a rope tied to prong aperture 40 on either side. So a pair of ropes one in aperture 40 could be pulled from the side or from some other position causing the actuating arm to move to the unlocked position.

Actuating arm also includes a cutout shaped like two arrows near the top which is a cutout 42 to provide a quick guide to show someone unfamiliar with the device whether it needs to be pushed in either direction in accordance with the arrows 42.

Figure 6:
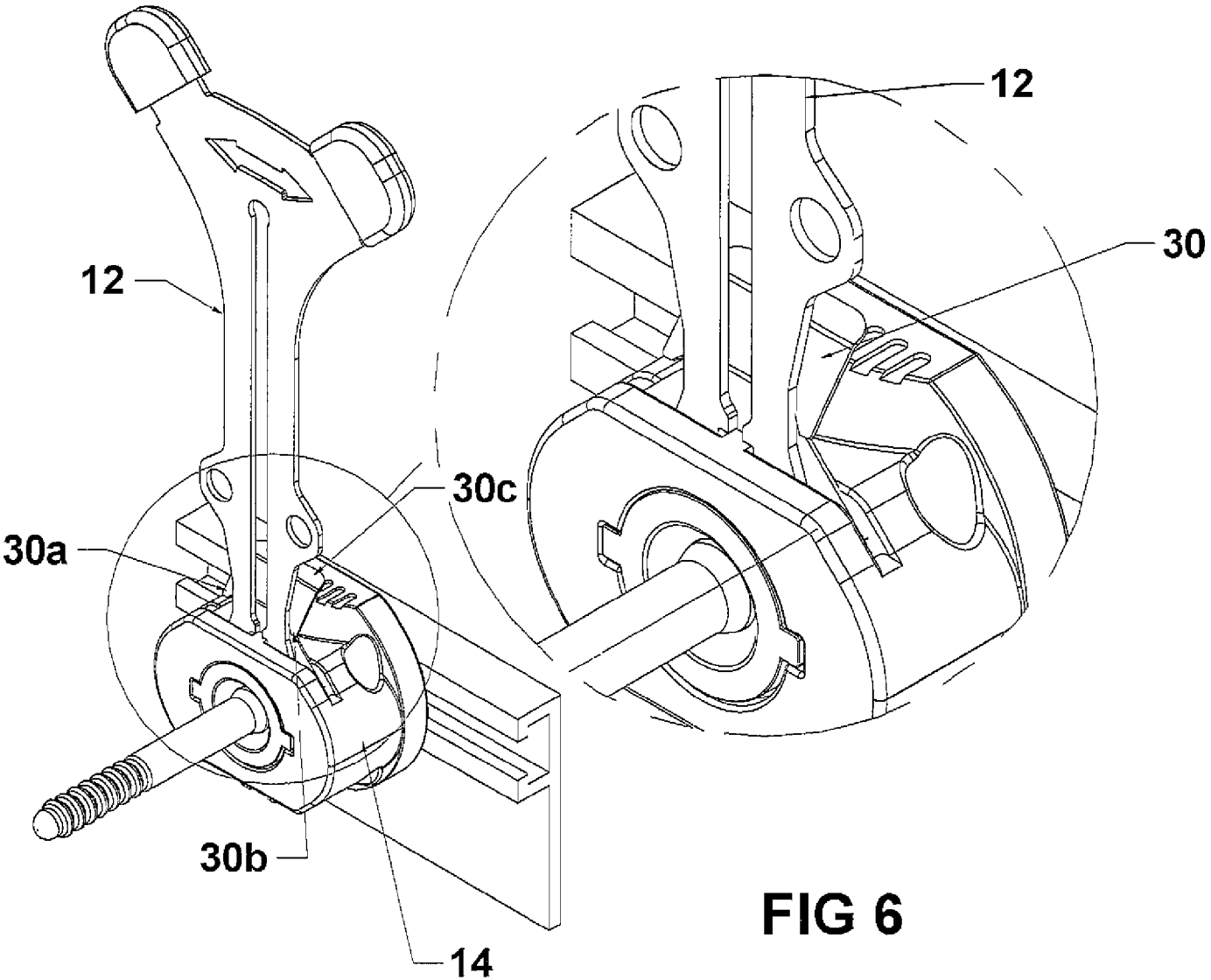
FIG. 6 shows the view of FIG. 5 the actuating arm in the vertical locked position and the stud locked therein with an enlarged insert.

Referring now to FIG. 5 and FIG. 6, the operation of the detent plate 30 is described. FIG. 5 shows the actuating arm 12 and each prong 12*a* and 12*b* of the actuating arm 12 rotated to the left side of the anchor where it is locked open by tab 30*a* projecting forward from the detent plate 30 which is also vertically positioned in the anchor. Tab 30*b* does not engage aim 12 in this position because tab 30*a* holds prong 12*a*. The stud is shown removed from the anchor in this position. However, referring to FIG. 6, the retention tab 30 and the actuating arm 12 are shown in the locked position with the actuating arm centered between tabs 30*a* and 30*b*. In this position, the actuating arm is vertical and the stud is locked in position and cannot be removed. The only way the stud 22 can be removed is for the actuating arm to be moved to the left or to the right as shown in FIG. 5. Also, in the position shown in FIG. 5, the detent tab 30 back upper portion 30*c* can be pushed backwards due to its flexibility which moves tabs 30*a* and 30*b* rearwardly, allowing the actuating arm 12 to be easily moved to the center (vertical) locked position. During installation in accordance with FIG. 5, the stud 22 would be manually inserted into the passage in the anchor 14 with the actuating aim 12 locked open (either to the left or to the right). Once the stud 22 is properly positioned in the anchor 14, then the upper portion of the detent tab 30*c* will be depressed and the arm 12 can be moved easily to the center vertical position, locking the stud in place. In an escape situation, the arm 12 can be moved left or right to a locked open position which freely allows the stud to be removed or pushed away in the open position.

The instant invention has been shown and described herein in what is considered to be the most practical and preferred embodiment. The applicants recognize, however, that departures may be made therefrom within the scope of the invention and that obvious modifications will occur to a person skilled in the art.

What is claimed is:

1. A storm shutter panel stud fastener mechanism for quickly releasing and removing a storm shutter panel engaged over a window or door of a building comprising:

means for fastening a stud for attachment to a storm shutter panel to a building exterior wall;

movable actuating member connected to said means for fastening a stud to a building exterior wall, said actuating arm engaging and securing said stud in a first position and releasing said stud when moved to a second position providing a quick release of the stud from the stud fastening means; and said means for fastening said stud to said building includes an anchor having a housing that includes a slot sized to receive a portion of the actuating arm prongs, said interior anchor housing including a pair of stops spaced and sized to engage said actuating arm prongs, such that when the actuating arm is pivoted in either direction, the prongs will be spread apart increasing the diameter and distance of the prongs to release a stud having a lesser diameter.

2. A device as in claim 1, including:

wherein said actuating member is a movable actuating arm, said actuating arm having a pair of prongs spaced apart a pre-determined distance, the prongs being separated by an elongated slot and each prong having a curved semi-circular portion separated on each side of said prongs such that the semi-curved portion creates a diameter sized to engage the outside diameter of a stud at a specific location for securing the stud to the actuating arm.

3. A device as in claim 1, including:

a detent mechanism that automatically locks the actuating arm into the "release" position once the operator moves the activation arm into said release position.

4. A device as in claim 1, including:

at least one shutter panel;

said means for fastening said stud to said building includes a means for attaching a rope that can be secured to said shutter panel; and a rope connected to said means for attaching a rope.

5. A storm shutter stud fastening mechanism for securing and releasing a storm shutter stud providing quick release of the stud from the shutter to allow egress of a building occupant comprising:

a storm shutter stud anchor connectable to a building for securing a storm shutter;

a shutter fastening stud removably connectable to said stud anchor;

an actuating arm connectable to said storm shutter anchor and said stud to hold said stud securely to said anchor in a first position and to release said stud from said anchor when manually pivoted to a second position thereby releasing the stud from the anchor; and said stud anchor includes a rigid housing having a first central passage disposed longitudinally and a second slotted passage perpendicular to said first passage, said first passage sized to receive a stud, said stud anchor includes a pair of stops located in said second passageway for causing said actuating arm prongs to spread apart when the actuating arm is moved and rotated in either direction against said two stops.

6. A device as in claim 5, including:

said stud anchor includes a passage for receiving a rope which can be tied to the anchor and to a shutter; and said actuating arm includes at least one aperture for receiving a rope near the top of the actuating arm for remotely accessing and actuating the actuating arm using a rope connected to and tied to the actuating arm.

* * * * *